United States Patent [19]

Van Erden et al.

[11] Patent Number: 4,589,145

[45] Date of Patent: May 13, 1986

[54] PACKAGING MATERIAL AND PACKAGE

[75] Inventors: Donald L. Van Erden, Wildwood, Ill.; Steven Ausnit, New York City, N.Y.

[73] Assignee: Signode Corporation, Glenview, Ill.

[21] Appl. No.: 547,392

[22] Filed: Oct. 31, 1983

[51] Int. Cl.[4] ..... B65D 30/00

[52] U.S. Cl. ..... 383/5; 383/63; 383/65; 206/459; 206/605; 206/610; 206/632; 53/410; 53/450

[58] Field of Search ..... 206/459, 604, 605, 608, 206/610, 612, 632, 633; 383/63, 64, 65, 15; 53/410, 412, 453, 450

[56] References Cited

U.S. PATENT DOCUMENTS

| | | | |
|---|---|---|---|
| 2,780,261 | 2/1957 | Svec et al. | 150/3 |
| 2,871,539 | 5/1956 | Swan | 24/201 |
| 3,054,434 | 9/1962 | Ausnit et al. | 150/3 |
| 3,095,088 | 6/1963 | Blaikie et al. | 206/610 |
| 3,179,327 | 4/1965 | Burton et al. | 206/459 |
| 3,198,228 | 8/1965 | Naito | 150/3 |
| 3,226,787 | 1/1966 | Ausnit | 24/201 |
| 3,274,746 | 9/1966 | James et al. | 53/22 |
| 3,325,084 | 6/1967 | Ausnit | 229/77 |
| 3,347,298 | 10/1967 | Ausnit et al. | 150/3 |
| 3,405,861 | 10/1968 | Bush | 206/604 |
| 3,462,332 | 8/1969 | Goto | 156/244 |
| 3,616,990 | 11/1971 | Powell | 206/610 |
| 3,625,270 | 12/1971 | Skendzie | 150/3 |
| 3,685,562 | 8/1972 | Ausnit | 150/3 |
| 3,780,781 | 12/1973 | Uramoto | 150/3 |
| 3,827,472 | 8/1974 | Uramoto | 150/3 |
| 3,886,633 | 6/1975 | Ausnit | 24/201 |
| 3,948,705 | 4/1976 | Ausnit | 156/73.4 |
| 4,240,241 | 12/1980 | Sanborn, Jr. | 53/412 |
| 4,246,288 | 1/1981 | Sanborn, Jr. | 426/122 |
| 4,372,793 | 2/1983 | Herz | 156/66 |

*Primary Examiner*—Joseph Man-Fu Moy
*Assistant Examiner*—David T. Fidei
*Attorney, Agent, or Firm*—Hill, Van Santen, Steadman & Simpson

[57] ABSTRACT

A method of and apparatus for packaging a blocky product such as cheese, into a wrapped envelope package, with material especially adapted for said packaging and wherein a bottom face of the product article is engaged on a panel area of the wrapper sheet which sheet has extended portions that are wrapped about the article and sealed across a top face of the article, with one of the portions of the wrapper sheet having a reclosable zipper and a web portion alongside said zipper which is adapted to be severed or ruptured to provide a mouth opening for access to the article within the package and the mouth opening being reclosable by the enclosed zipper. The zipper may be provided with structure to prevent its being pulled open during the wrapping and sealing of the wrapper about the article. The web portion may have guidance for severing or rupturing the same when access is desired into the package.

10 Claims, 7 Drawing Figures

PACKAGING MATERIAL AND PACKAGE

BACKGROUND OF THE INVENTION

1. Field of the Invention

This invention relates to the art of packaging and is more particularly concerned with packaging adapted to be effected in a horizontal on-line manner for packaging chunky product or articles such as cheese, and in which the packages will be equipped with reclosable zipper means.

2. Background

A very large capital investment has been made in form, fill and seal machines for packaging numerous and varied products. In these machines the product is enclosed for commercial distribution in sealed packages, envelopes or bags. A large volume of food products of a relative chunky, heavy type such as bulk or sliced cheese, have been packaged in horizontal form, fill and seal machines.

Although the horizontal form, fill and seal machines have been in use for a long time, the only type of packaging effected has involved wrapping of the wrapping material about the product and sealing along a longitudinal line and then cross sealing to complete the package.

To gain access to the product in the packages, the wrapper, generally plastic film, must be cut or otherwise broken open. If it is desired to replace into the opened wrapper the remainder of the product which has not been consumed, assuming the wrapper has not been destroyed in the opening of it, the remainder of the product may be at least partially exposed to atmosphere and subject to drying out or other deterioration due to the exposure. Because the wrapper generally snugly engages the article it is difficult to withdraw from the partially ruptured wrapper so that the tendency is for the consumer to virtually destroy the wrapper to gain access to the article even though only partial use of the article is contemplated. This may require rewrapping in foil or household wrapping film in an attempt to retain freshness.

Although zipper equipped bags have been known for a long time and are widely used both for commercially packaged products, and unfilled bags have been supplied in large numbers for household use as sandwich bags, and the like, there has never insofar as we are aware been supplied a package produced on a conventional horizontal form, fill and seal machine and equipped with zipper means so that the package can be reclosed after access has been gained to the product in the package.

PRIOR ART

By way of example, U.S. Pat. No. 3,274,746 is referred to as representative of existing conventional horizontal form, fill and seal apparatus for packaging relatively heavy articles such as cheese in plastic film or the like. The method there disclosed consists in running the wrapper sheet in the form of a continuous strip along a horizontal packaging line wherein the wrapper sheet is wrapped about the product articles successively placed thereon in spaced units, by folding the sheet from opposite sides onto the articles and sealing the opposite longitudinal margins of the sheet together. Finally, the sheet which has, in effect, been sealed into a tubular envelope about the articles, is sealed across the envelope between the articles and separated into sealed individual article-containing package units. This mode of packaging has been practiced for a long time without any significant change in the package in spite of the disadvantages previously mentioned.

Attention is also directed to U.S. Pat. Nos. 4,240,241 and 4,246,288 which disclose a technique for packaging according to which semi-rigid receptacles are formed in one layer of plastic web and a cover sheet is sealed marginally to each receptacle, the receptacle and the cover sheet having interlocking rib and groove closure strip, i.e. zipper, so that when the sealed package is opened the same may be reclosed by means of the zipper. However, that technique involves a very different form, fill and seal apparatus than the virtually standard horizontal form, fill and seal machines which have long been used for sealing various food products, and in particular cheese. Therefore, in order to adopt the packaging of these two patents, the horizontal form, fill and seal machines now extensively used would have to be scrapped and the investment therein lost. The very large capital investment for installing machines adapted for producing reclosable packages according to these patents presents a formidable deterent to their adoption.

Bags equipped with resiliently flexible zipper means have been provided for receiving various food and non-food products and adapted for access into the tops of the bags by opening the zipper. U.S. Pat. Nos. 3,198,228 and 3,462,332 show representative structures in which the zipper profiles are extruded integrally with the bag wall material or fused with the film or bag wall material at extrusion. U.S. Pat. Nos. 2,780,261, 3,054,434, 3,198,228, 3,347,298, and 3,886,633 disclose means for easy opening of the zippers externally of the bag but resistant to opening from separating forces generated as by means of the contents internally of the bag.

U.S. Pat. Nos. 3,780,781 and 3,948,705 represent structures wherein the zipper profile strips have base flanges which are fused to the bag wall film material.

U.S. Pat. No. 4,372,793 exemplifies adhesive attachment of the zipper strips to the bag film or side wall material.

U.S. Pat. Nos. 2,780,261, 2,871,539, 3,325,084, and 3,886,633 show examples of multiprofile zippers.

U.S. Pat. Nos. 3,226,787, 3,685,562, 3,827,472 and 3,625,270 disclose a tear strip structure to facilitate opening bags.

None of the listed patents meet the novel concepts of the present invention.

SUMMARY OF THE PRESENT INVENTION

An object of the present invention is to provide a new and improved method, packaging material, package and apparatus especially adapted for continuous on-line form, fill and seal production, the package being thoroughly sealed and provided with means for reclosing the package when opened.

Another object of the present invention is to provide a new and improved method of and means for producing zipper equipped packages on existing horizontal form, fill and seal machines with only relatively minor modifications and investment, while preserving the major capital investment in the equipment.

To this end, the present invention provides in a method of forming in a form, fill and seal machine a product enclosing package having an envelope with a face panel extending between opposite sides and end edges of the envelope, and including folding a wrapper sheet from opposite sides of said face panel into tubular shape and bringing longitudinal margins of the sheet into position opposite the face panel and sealing the margins together into a seam extending between said end edges, and then effecting cross seals at the opposite ends of the envelope, the improvement comprising providing within one side fold zipper means comprising reclosable separable fastener profiles extending between the cross seals and in parallel spaced relation to the seam, and leaving a pilfer-proof web extending between the cross seals and projecting outwardly from and along said fastener profiles, so that the envelope remains fully sealed until the web is ruptured to provide a package mouth opening which is adapted to be reclosed by closing the zipper means.

The present invention also provides in a product-enclosing package envelope formed from sheet material and having a face panel extending between opposite sides and end edges of the package, the sheet material being folded from opposite sides of the face panel into tubular envelope shape and with longitudinal margins of the sheet material sealed into a seam opposite the face panel and extending between the end edges of the envelope, and cross seals at the opposite end edges of the envelope, the improvement comprising zipper means comprising reclosable separable fastener profiles within one side fold of the envelope extending between the cross seals and in parallel relation to the seam, and a pilfer-proof web extending between the cross seals and projecting outwardly from and along the fastener profiles, so that the envelope remains fully sealed until the web is ruptured to provide a mouth opening into the package and which is adapted to be reclosed by closing said zipper means.

Likewise the present invention provides material especially adapted for packaging in a form, fill and seal machine a blocky product such as cheese having opposite faces and edges between the faces, comprising a wrapper sheet having a panel area for engagement with a face of the product, the sheet having portions which extend beyond the panel area and which are adapted to be wrapped into an envelope about the product by folding the sheet portions about the product edges and into engagement with the other face of the product, free margins of the sheet portions being adapted to be secured into a seam at the other face of the product, the wrapper sheet being dimensioned to provide for cross seals at the ends of the envelope, reclosable zipper means on one of the sheet portions, and a web fold of the one portion alongside the zipper means and adapted to be severed or ruptured to provide a package mouth opening for access to the product in the envelope, and the mouth opening being reclosable by means of the zipper means.

BRIEF DESCRIPTION OF THE DRAWINGS

Other objects, features and advantages of the present invention will be readily apparent from the following description of certain representative embodiments thereof, taken in conjunction with the accompanying drawings, although variations and modifications may be effected without departing from the spirit and scope of the novel concepts embodied in the disclosure, and in which:

In FIG. 1 is shown a fairly standard prior art wrapped package wherein a blocky product 10 such as cheese whether sliced or unsliced is packaged in a wrapper 11 which may comprise a plastic film envelope secured together across a face of the product by means of a seam 12 which extends from end-to-end of the package and may be sealed to cross seals 13 at opposite ends of the package. Packages of this type are adapted to be produced on horizontal form, fill and seal production line apparatus such as disclosed by way of example in the previously mentioned U.S. Pat. No. 3,274,746. In order to gain access to the product 10 within this package, the wrapper 11 is often indiscriminately torn off of the contents and destroyed, or it may be severed or ruptured, at one of the end seams 13, especially if it is desired to reuse the wrapper 11, by replacing as much of the article 10 has not been consumed in the remains of the wrapper 11. However, that part of the article which has been returned to the wrapper may suffer exposure at the wrapper opening; or if there is enough of the wrapper remaining about the opening, it may be folded over and a rubber band or the like, not always conveniently available, may be used to close the opening in the wrapper. In any event, this is an inconvenient manner of rewrapping the article and may expose the article at least partially to ambient atmosphere while stored for future use. Drying out and possible spoilage are common occurrences.

Figure 2:
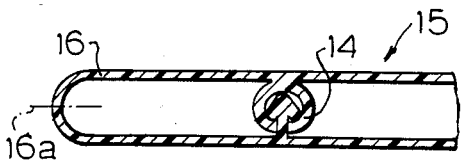
FIG. 2 is an illustrative enlarged fragmentary sectional detail view showing a typical prior art zipper equipped plastic bag construction.

Although reclosable zippers, such as the zipper 14 in FIG. 2, have been extensively used for reclosable plastic bags 15, such bags are generally limited to filling through either the top or bottom of the bag which is then closed as by sealing the same. Where the bag is provided with a tamperproof web 16 at the top or mouth of the bag, the normal filling procedure is through the open bottom of the bag which is then sealed. When it is desired to gain access to the bag contents, the web 16 is cut or fractured such as along a line **16*a* and the reclosable zipper 14** is then opened and the bag is adapted to be resealed by reclosing the zipper. Such top or bottom filling of bags is unsuitable for form, fill and seal packaging and especially chunky product such as cheese, and which requires that the product be placed on an upwardly facing area of the wrapper.

Figures 6, 7:
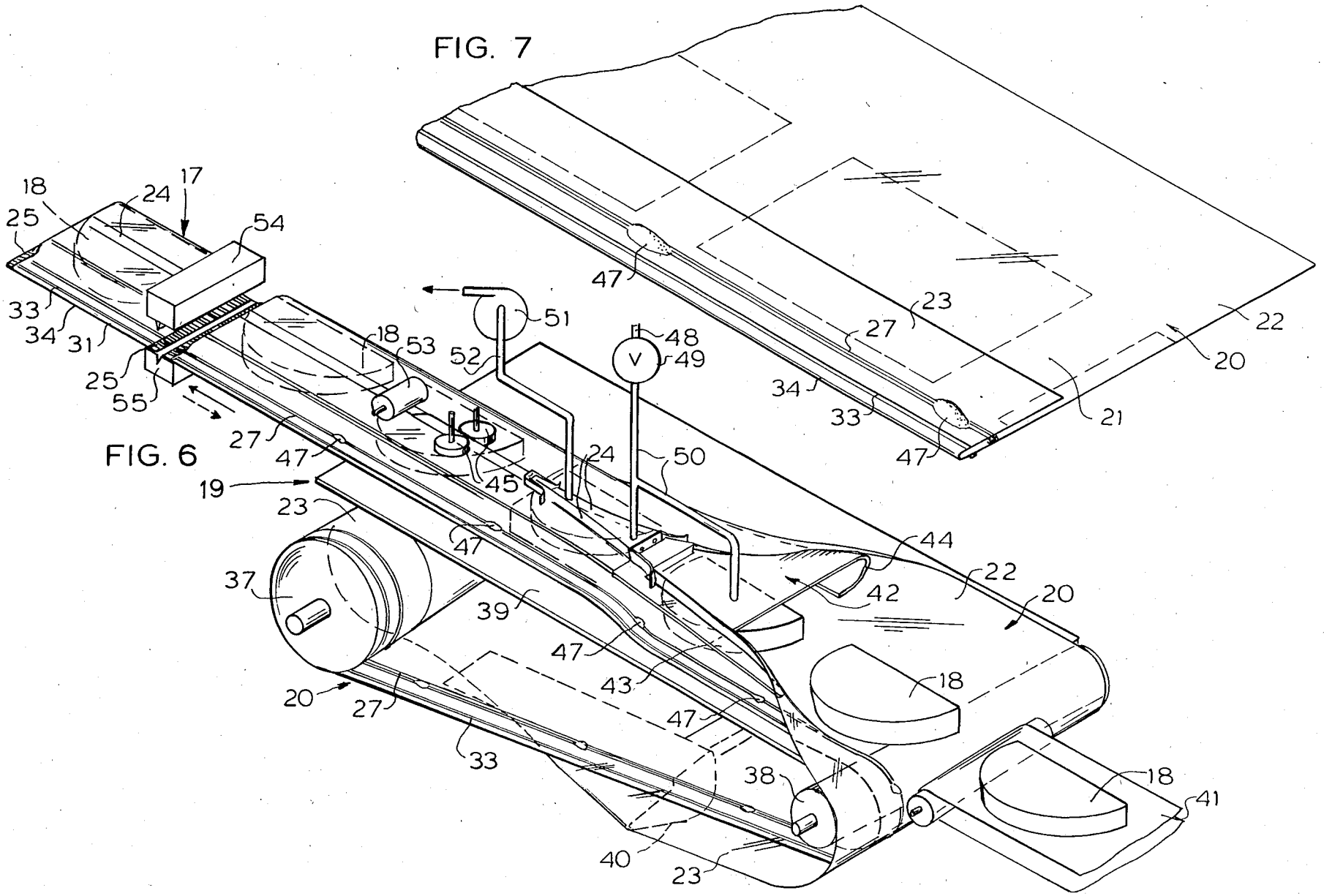
FIG. 6 is a fragmentary isometric view of wrapper sheet material according to the present invention.
FIG. 7 is a schematic illustration of a horizontal form, fill and seal machine packaging line with which the material of FIG. 6 is especially adapted to be used.

According to the present invention, zipper-equipped packages 17 (FIGS. 3–5) especially adapted for the packaging of bulky product 18 such as cheese may be produced along a horizontal form, fill and seal production line in apparatus 19 (FIG. 6) and utilizing prefabricated wrapper sheet material 20 (FIG. 7).

The envelope for each of the wrapped packages 17 comprises a panel area 21 (FIG. 3) of the sheet material 20 on which the bottom face of the product 18 is received. Substantial width portions of the wrapper sheet 20 which extend beyond the panel area 21 are wrapped up along edges of the product 18 and into overlying relation to the top face of the product. That is, a portion 22 of the wrapper is brought up along one side of the product 18 and over the top face of the product, and a portion 23 of the wrapper material 20 is brought up along the opposite side of the product and into overlying relation to the top face of the product. Means for securing the portions 22 and 23 of the wrapper sheet into a seam over the top face of the product comprise laminar margins of the portions 22 and 23 which are secured together in a seam 24 as by heat sealing where the material of the wrapper is a thermoplastic film, or may be secured adhesively where that is more feasible. At its opposite ends, the tubular wrapper thus formed is adapted to be closingly cross sealed as by means of heat sealed seams 25.

Figure 4:
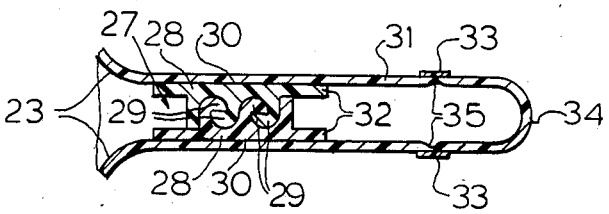
PRIOR ART FIG. 4
FIG. 4 is an enlarged fragmentary sectional detail view taken substantially along the line IV—IV in FIG. 3 showing a preferred reclosable zipper and the severable or rupturable tamperproof web sealing closure for the package.
Figure 1:
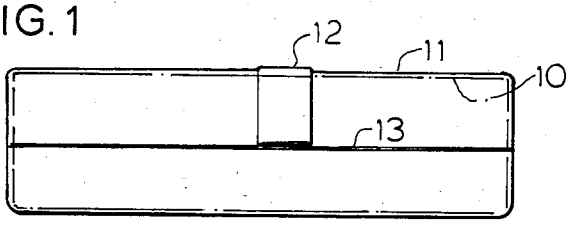
FIG. 1 is an end elevational view of a prior art plastic sheet wrapped package.

Outside of the area 21 on which the bottom of the product 18 is received, and desirably part of one of the wrapper portions 22 and 23, herein the portion 23, reclosable elastically deformable plastic zipper means 27 are provided. As best seen in FIG. 4, which is substantially enlarged for illustrative purposes, the zipper 27 comprises a pair of complementary extruded plastic multi-rib and groove interlockable strips 28 each of which has a pair of generally hook shaped ribs which are adapted to be pressed into interengagement within complementary grooves defined in the strips alongside the respective ribs. Each of the fastener strips 28 has a base surface 30 which is secured in any preferred manner to the opposite walls within a tamperproof closure fold 31 of the wrapper portion 23. If preferred each of the zipper strips 28 may have base flange extensions 32 at either or both sides of the strip. Although the zipper strips 28 may be secured by a fusion or welding of the base surfaces 30 to the film portion 31, where fusibly incompatible plastic materials are employed, the zipper strips 28 are adapted to be attached or cemented adhesively as by means of hot melt adhesive. If preferred, of course, single complementary rib and groove zipper such as shown in FIG. 2 may be used.

Where both the film of the wrapper and the profile strips of the zipper are extruded from polyethylene, fusion joinder of the zipper strips to the film is feasible. On the other hand, where the materials of the zipper and wrapper film are not fusibly compatible, such as where the zipper profiles are extruded from materials selected from vinyl type resins such as polyvinyl chloride, polyvinyl acetate, polyvinyl chloridepolyvinyl acetate copolymers, and similar vinyl resins or polyethylene, and the wrapper film comprises polypropylene or other material fusibly incompatible with the material of the zipper, the zipper may be secured to the film by cementing or adhesively. For this purpose, a hot melt adhesive selected from ethylene vinyl acetate, ethylene acrylic acid, polymer rubber resin blend, and the like, may be employed.

Although the profiles of the zipper 27 need not necessarily be closed together in the completed package 17, where the chunky product 18 is such that it would be susceptible of possibly filling in the grooves of the zipper strips 28, it is desirable to have the zipper closed within the fold 31. Outwardly from the zipper 27, the fold 31 provides a closure web which maintains the sealed integrity of the package until the closure web 31 is severed or ruptured to gain access to the zipper 27 for opening the zipper to provide an open mouth for access to the product 18.

Figure 5:
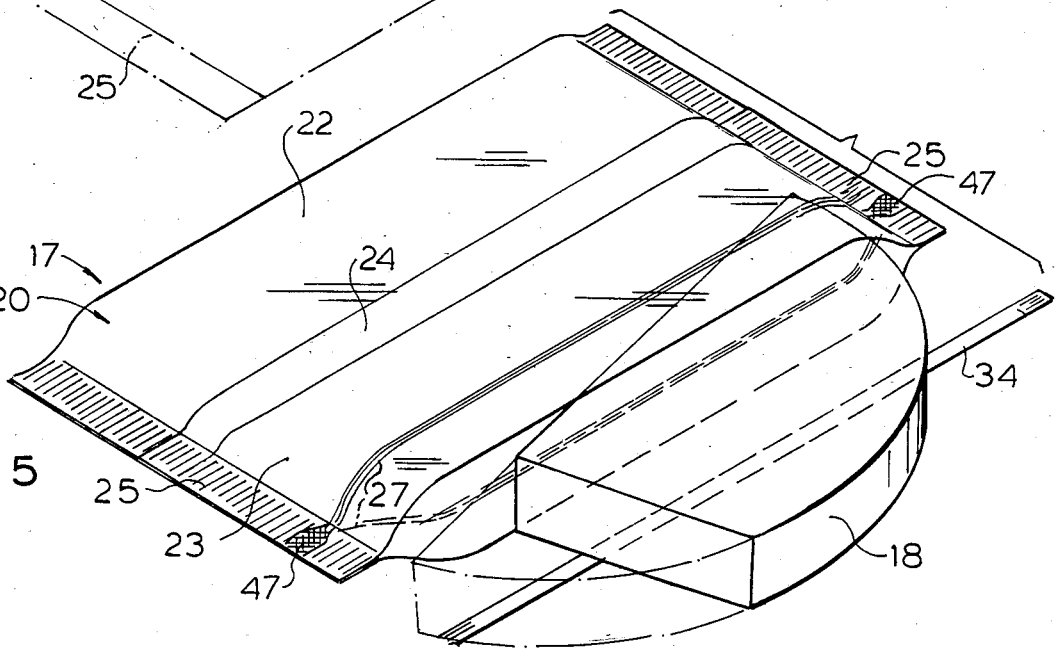
FIG. 5 illustrates how the package of FIG. 4 is adapted to be opened for access to the contents.

For convenience of the user in opening the package 17, the fold 31 may be provided with severance line indicia 33 extending longitudinally therealong spaced not only from the zipper 27 but from a juncture 34 of the fold outwardly from the indicia. On the other hand whether or not the indicia 33 is provided, the opposite walls of the fold 31 may be provided with aligned lines of weakening 35 along which the fold may be ruptured or severed. After the fold 31 has been severed and the material along the fold juncture bend 34 has been removed, as indicated in FIG. 5, the portions of the fold attached to the respective zipper profile strips 28 may be grasped as pull-flanges to pull the zipper profiles apart whereby to open the mouth of the bag for access to the product 18. Thereafter, if it is desired to return a remaining portion of the product, after a part has been removed as indicated by dot dash lines in FIG. 5, the remaining portion may be readily returned to the pouch provided by the opened wrapper and the zipper closed to provide a substantial seal for the reclosed pouch within which the product 18 will be protected against contamination or drying out. After the product 18 has been entirely consumed the reclosable pouch may be conveniently reused for containing other product or article.

As shown in FIGS. 6 and 7, the wrapper material 20 is adapted to be supplied in continuous sheet form which may be rolled up in a roll 37 for convenient feeding to the horizontal production line of the apparatus 19. As thus supplied, the product receiving area 21 of the wrapper portion 22 in the strip may be flat and the folded over zipper equipped portion 23 may be flattened as a flap onto the article receiving area 21 of the sheet material. As fed from the roll 37, the sheet material may be guided over a guide roller 38, which may be driven or not as circumstances may dictate, and from which the material 20 moves onward on a horizontal supporting structure 39, which may be a frame or table or a transporting conveyor, whichever may be preferred. Before the wrapper material reaches the roller 38, the flap portion 23 may be deflected by means 40 away from the panel area 21 to clear the same for receiving the product 18.

As the wrapper material 20 is guided onto the supporting structure 39, the product 18 to be wrapped may be delivered as by means of a conveyor 41 in successive suitably spaced individual article relation onto the upper face of the panel area 21 of the wrapper material and adjacent to the zipper 27.

As each of the product articles 18 advances with the wrapper 20, means comprising a device 42 serves to fold the wrapper portion 22 from one side and the wrapper portion flap 23 from the other side and about the product 18 as the assembly advances in the wrapping path along the horizontal production line of the form, fill machine 19. Control plate means 43 of the device 42 folds the wrapper portion 23 onto the product 18. At the same time control plate means 44 of the device 42 gradually lifts the wrapper portion 22 and wraps it about the successive product articles 18. As the portions 23 and 22 of the wrapper advance along the device 42, top seal margins 24 of the wrapper portions 22 and 23 are moved into generally vertical position and are brought convergently together for sealing into a seam as by means of a pair of cooperating sealing pinch rolls 45 by which the margins 24 are heat sealed, if feasible, or which may cause the margins 24 to be adhesively secured where adhesive sealing is preferred. Sealing bars may be used instead of the rolls 45.

Where it is preferred to have the zipper means 27 closed and to remain closed throughout the wrapping process, means are desirably provided for assuring that as the product 18 is wrapped and the wrapper 20 snugged about the articles, the zipper means will not open. In one desirable arrangement, the zipper means 27 may be provided with spot seals 47 at the intervals along the zipper at which the wrappers for the individual product articles 18 will be sealed across the eventually fully longitudinally sealed wrapper material 20. Advantageously, such seals 47 reduce the thickness of the material layers to be cross-sealed, so as not to impair normal operation of the machine. On the other hand, the zipper profiles 29 may embody techniques such as disclosed in U.S. Pat. Nos. 2,780,261 or 3,198,228 wherein the structure of the zipper profiles will resist opening force exerted from the inside of the package to a substantially greater extent than opening force applied externally, that is from the outside of the package, and more particularly through the pull flange areas extending outwardly relative to the zipper after the pilferproof web fold 31 has been opened.

Figure 3:
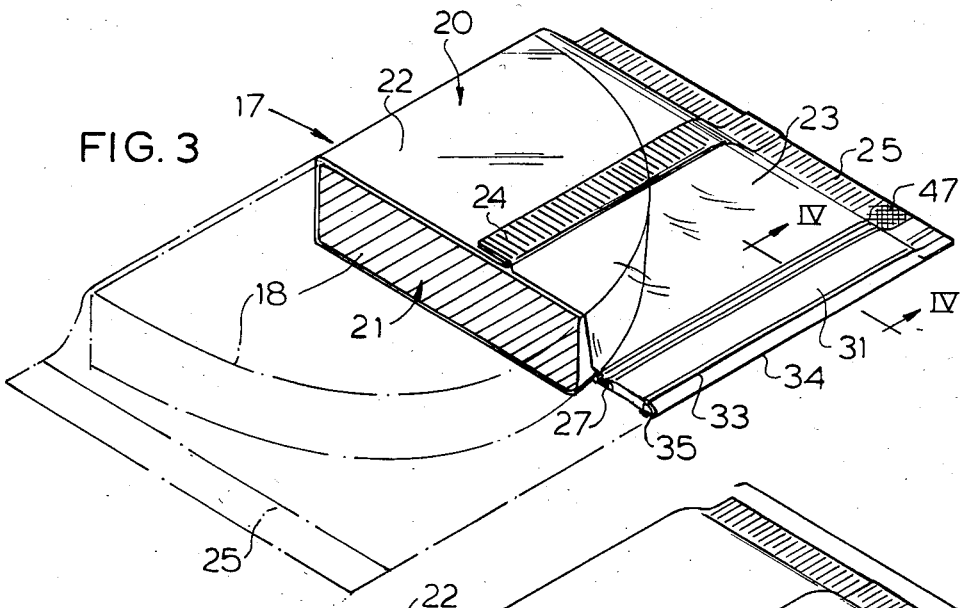
PRIOR ART FIG. 3
FIG. 3 is a schematic illustration showing a package embodying the present invention.

As the package material and article assembly moves past the controlling device 42, the articles may be flushed with an inert oxygen purging gas such as nitrogen supplied from a suitable source through a conduit 48 controlled by a valve 49 and delivered to the packaging line through branched ducts 50. If desired, in order to assure reasonably snugged engagement of the wrapper with the product articles 18, means may be provided downstream from the device 42 comprising a suction device such as a vacuum pump or blower 51 and communicating with the interior of the package assembly as by means of a duct 52. As seen in FIG. 3, the zipper means 27 maintains the envelope of the wrapper in snugged engagement with the bulky article.

Downstream from the sealing means rolls 45, means comprising a flattening roller 53 may turn the sealed margins 24 over flat onto the top of the package assembly, and then the assembly is separated into the individual sealed packages 17. Such separation may be effected by means of cooperating heat sealing bars 54 and 55 which are cooperatively reciprocable relative to one another for not only forming the cross seals 25 across the ends of the packages but also for providing a tear line for effecting severance for separating each successive package from the packaging assembly along transverse lines aligned with the spot seals 47.

In addition, the bars 54 and 55 may be adapted to function as means for advancing the packaging assembly by package increments. For this purpose the bars 54 and 55 may be adapted for joint reciprocation in a back and forth manner as indicated by arrows 57, the dot dash arrow indicating movement of the bars 54 and 55 in open position to return engaging for a seam area between the next to be separated package which has its downstream side already sealed and the following package from which the next to be separated package is to be separated. By cyclically clamping of the bars 54 and 55 at the upstream side of the next to be separated package and then drawing the assembly a package increment downstream as indicated by the full line arrow 57 and effecting full sealing and separation of the package, a continuous, stepped advance of the packaging assembly is effected.

It will be understood that variations and modifications may be effected without departing from the spirit and scope of the novel concepts of this invention. For example, this invention may be used to package loose pieces of hard candy, peanuts, and similar products and may be adapted to certain types of vertical form, fill, and seal machines.

What is claimed is:

1. In a wrapped bulky product-enclosing package formed from a single sheet or wrapper and having a face panel extending between opposite sides and end edges of the package, said sheet material being folded from opposite sides of the face panel into tubular envelope shape and with longitudinal margins of the sheet material sealed into a seam opposite said face panel and extending between said end edges of the envelope, and cross seals at said opposite end edges of the envelope, the improvement comprising:

zipper means comprising reclosable separable fastener profiles within one side fold of the package extending between said cross seals and in parallel relation to said seans;

said zipper means being enclosed within the package and maintaining said envelope snugged against the wrapped bulky product;

a pilfer-proof web extending between said cross seals and projecting outwardly from and along said fastener profiles, so that the envelope remains fully sealed until said web is ruptured to provide a mouth opening into the package and which is adapted to be reclosed by closing said zipper means;

said zipper means comprising profiled resiliently flexible separable zipper strips having the profiles in closed zipper relation alongside said pilfer-proof web fold;

and means for resisting separation of said zipper profiles during a product wrapping operation and in the package.

2. A package according to claim 1, wherein said web has means for guiding severance or rupture for opening the web.

3. A package according to claim 2, wherein said guiding means comprises guiding indicia on said web.

4. A package according to claim 3, including thinning of the material of said web in alignment with said indicia.

5. A package according to claim 2, wherein said web comprises a fold, and said guiding means extends along lines aligned with one another along opposite portions of said web fold.

6. Material especially adapted for packaging in a form, fill and seal machine a blocky product such as cheese having opposite faces and edges between said faces, comprising:

a wrapper sheet having a panel area for engagement with a face of said product;

said sheet having portions which extend beyond said panel area and which are adapted to be wrapped into an envelope about said product by bringing said portions up along said product edges and into overlying relation on said top face of said product;

free margins of the wrapper sheet portions being adapted to be secured into a seam over said top face of said product;

said wrapper sheet being dimensioned to provide for cross seals at the ends of the envelope;

reclosable zipper means extending lengthwise on and along one of said sheet portions and maintaining a fold of said one sheet portion closed;

said fold having a pilfer-proof web along said zipper means and adapted to be severed or ruptured to provide a package mouth opening for access to the product in the envelope, and the mouth opening being reclosable by means of said zipper means;

said zipper means comprising profiled resiliently flexible separable zipper strips having the profiles in closed zipper relation alongside said web fold;

and means for resisting separation of said zipper profiles during a product wrapping operation.

7. Material according to claim 6, wherein said zipper means comprises extruded profiled strips having base surfaces, and means securing said base surfaces to said sheet.

8. Material according to claim 6, wherein said means for resisting separation comprises spot sealing of said zipper profiles at package length intervals.

9. Material according to claim 6, wherein said one sheet portion partially separably overlies said panel area, and the other of said sheet portions extends in the plane of said panel area and is adapted to be wrapped over a product article on said panel area and into engagement with said one portion and over the article which has been engaged between said one portion and said panel area.

10. A wrapped bulky product-enclosing package according to claim 1, wherein said means for resisting separation comprises spot sealing of said zipper profiles at said cross seals.

* * * * *